United States Patent [19]

Walker

[11] 4,169,401

[45] Oct. 2, 1979

[54] CIRCUIT FOR REDUCING SOLENOID HOLD-IN POWER IN ELECTRONIC PLAYER PIANOS AND SIMILAR KEYBOARD OPERATED INSTRUMENTS

[75] Inventor: Henry V. Walker, Franklin, Tenn.

[73] Assignee: Teledyne Industries, Inc., Los Angeles, Calif.

[21] Appl. No.: 792,849

[22] Filed: May 2, 1977

[51] Int. Cl.[2] ..... G10C 3/20; G10F/1/02

[52] U.S. Cl. ..... 84/22; 84/115; 84/246; 361/154

[58] Field of Search ..... 84/1.01, 1.02, 1.03, 84/1.28, 19–23, 115, 246; 361/154

[56] References Cited

U.S. PATENT DOCUMENTS

| | | | |
|---|---|---|---|
| 3,864,608 | 2/1975 | Normile et al. | 361/154 |
| 3,868,882 | 3/1975 | Fukui et al. | 84/115 X |
| 4,104,950 | 8/1978 | Finley | 84/1.01 X |

*Primary Examiner*—Stanley J. Witkowski
*Attorney, Agent, or Firm*—Jim Zegeer

[57] ABSTRACT

There is disclosed a method and apparatus for reducing the power required to activate the soft and playing mechanism of an electronic player piano and similar instruments. In accordance with the invention, full voltage on the solenoid is maintained for a short period of time which is more than sufficient to allow full travel of the solenoid and then the power is reduced by reducing the applied voltage. In accordance with the preferred embodiment, a timer is started when the solenoid is commanded on and then when the timer times out, the command gate signal is turned on and off with a waveform which can be set at a duty cycle sufficient to maintain the solenoid in the held-in position.

3 Claims, 5 Drawing Figures

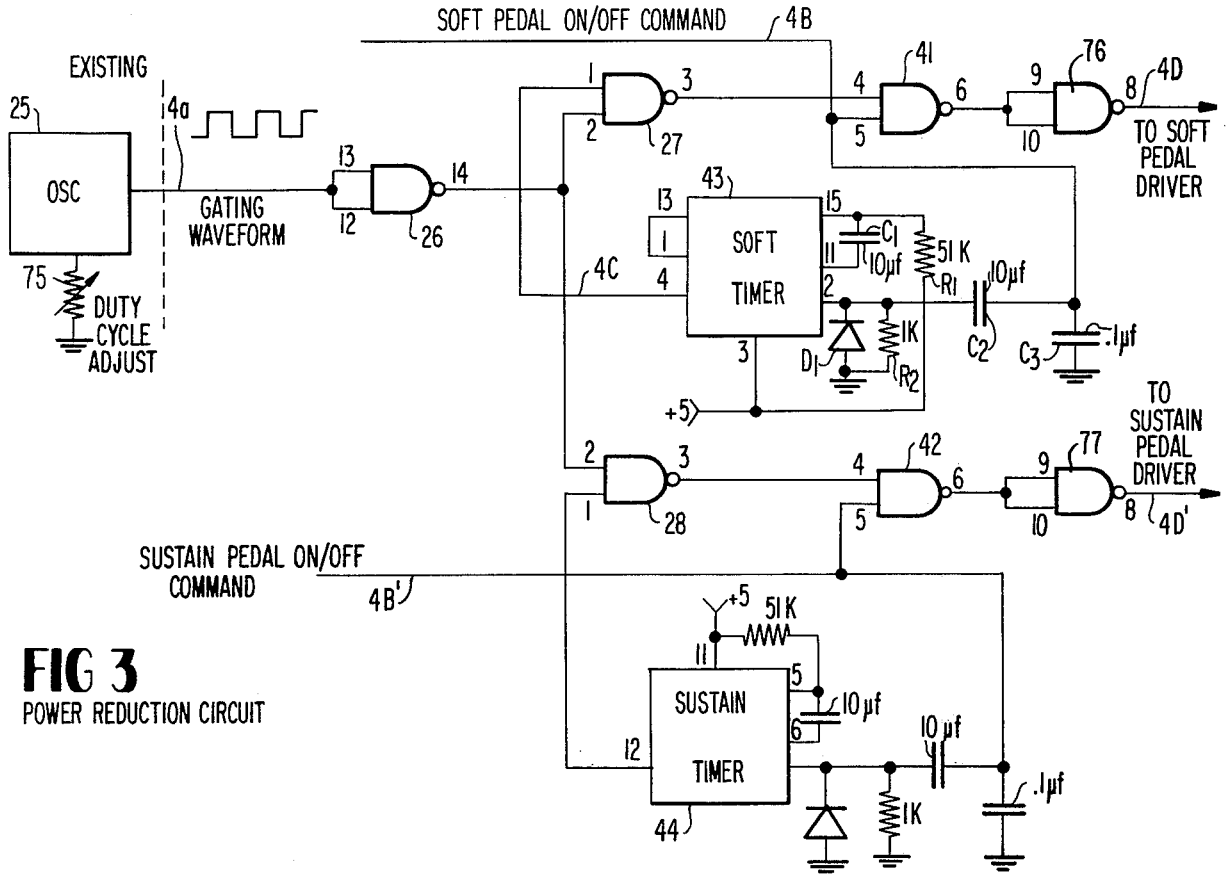
FIG 3
POWER REDUCTION CIRCUIT
FIG 4 POWER REDUCTION WAVEFORM
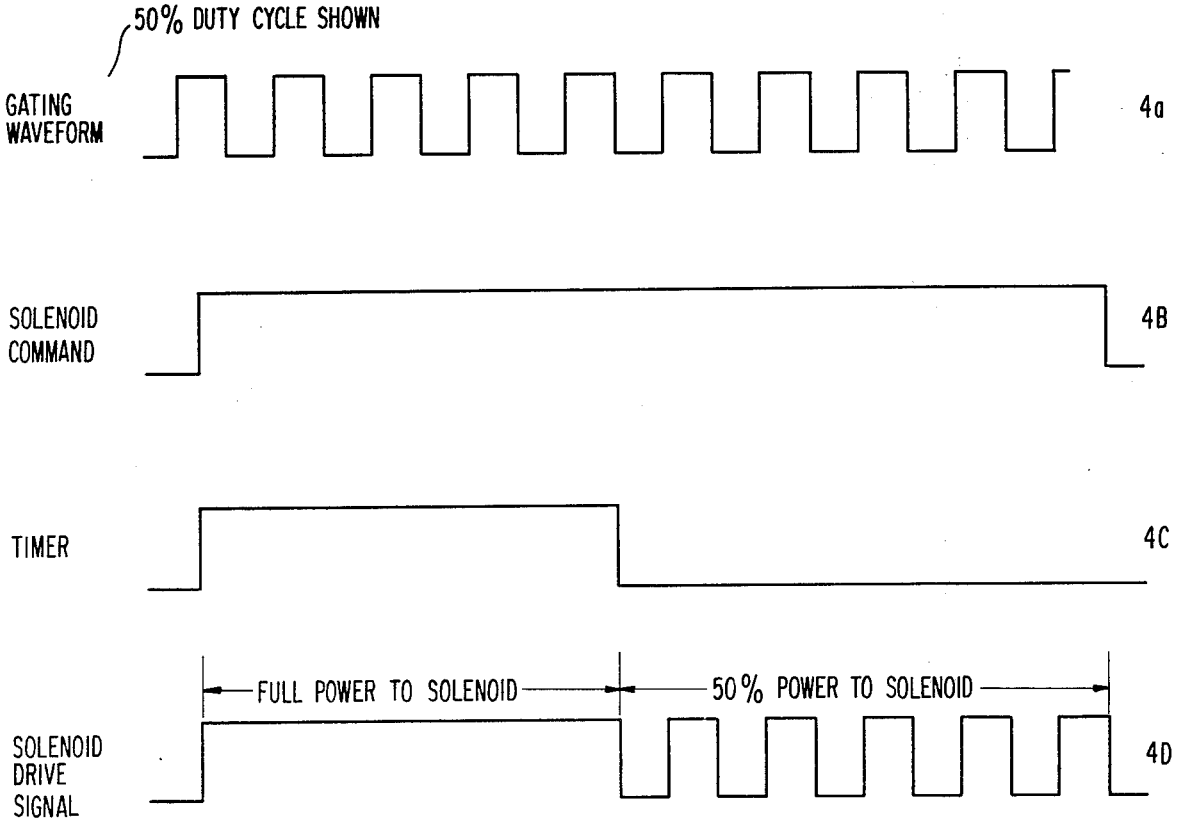

BIT ASSIGNMENT

| | | | | | |
|---|---|---|---|---|---|
| 1. | $C\#_{16}$ | 44. | G# | 87. | $B_{32}$ |
| 2. | D | 45. | A | 88. | $C_{16}$ |
| 3. | D# | 46. | A# | 89. | |
| 4. | E | 47. | B | 90. | |
| 5. | F | 48. | C | 91. | |
| 6. | F# | 49. | C# | 92. | 0 |
| 7. | G | 50. | D | 93. | |
| 8. | G# | 51. | D# | 94. | |
| 9. | A | 52. | E | 95. | |
| 10. | A# | 53. | F | 96. | |
| 11. | B | 54. | F# | 97. | |
| 12. | C | 55. | G | 98. | 0 |
| 13. | C# | 56. | G# | 99. | |
| 14. | D | 57. | A | 100. | |
| 15. | D# | 58. | A# | 101. | |
| 16. | E | 59. | B | 102. | |
| 17. | F | 60. | C | 103. | |
| 18. | F# | 61. | C# | 104. | 0 |
| 19. | G | 62. | D | 105. | BASS THEME |
| 20. | G# | 63. | D# | 106. | BASS INTENSITY 1 |
| 21. | A | 64. | E | 107. | BASS INTENSITY 2 |
| 22. | A# | 65. | F | 108. | BASS INTENSITY 3 |
| 23. | B | 66. | F# | 109. | BASS INTENSITY 4 |
| 24. | C | 67. | G | 110. | 0 |
| 25. | C# | 68. | G# | 111. | TREBLE THEME |
| 26. | D | 69. | A | 112. | TREBLE INTENSITY 1 |
| 27. | D# | 70. | A# | 113. | TREBLE INTENSITY 2 |
| 28. | E | 71. | B | 114. | TREBLE INTENSITY 3 |
| 29. | F | 72. | C | 115. | TREBLE INTENSITY 4 |
| 30. | F# | 73. | C# | 116. | 0 |
| 31. | G | 74. | D | 117. | SUSTAIN PEDAL |
| 32. | G# | 75. | D# | 118. | SOFT PEDAL |
| 33. | A | 76. | E | 119. | |
| 34. | A# | 77. | F | 120. | |
| 35. | B | 78. | F# | 121. | 1 |
| 36. | C (MIDDLE) | 79. | G | 122. | 1 |
| 37. | C# | 80. | G# | 123. | 1 |
| 38. | D | 81. | A | 124. | 1 |
| 39. | D# | 82. | A# | 125. | 1 SYNC |
| 40. | E | 83. | B | 126. | 1 |
| 41. | F | 84. | C | 127. | 0 |
| 42. | F# | 85. | $A_{32}$ | 128. | 1 |
| 43. | G | 86. | $A\#_{32}$ | | |

(14 UNASSIGNED BITS)

FIG. 5

CIRCUIT FOR REDUCING SOLENOID HOLD-IN POWER IN ELECTRONIC PLAYER PIANOS AND SIMILAR KEYBOARD OPERATED INSTRUMENTS

RELATED APPLICATIONS

This application is related to the following applications: U.S. Ser. No. 681,093, filed Apr. 28, 1976 for "Method and Apparatus For Reproducing A Musical Presentation" of Joseph Max Campbell and now U.S. Pat. No. 4,132,142; Ser. No. 681,098, filed Apr. 28, 1976 for "Demultiplex and Storage System For Time Division Multiplexed Frames of Musical Data" of William Solon Finley and now U.S. Pat. No. 4,104,950; and Ser. No. 680,996, filed Apr. 28, 1976 for "Solenoid-Hammer Control System For The Re-Creation of Expression Effects From A Recorded Musical Presentation" of Joseph Max Campbell and William Solon Finley and now U.S. Pat. No. 4,132,141, all of which are assigned to Teledyne Industries, Inc., the assignee hereof.

BACKGROUND OF THE INVENTION AND BRIEF DESCRIPTION

In the playing of a player piano by electronic means, a strong solenoid is required to activate the "soft" and "sustain" playing mechanisms of the piano. In order to obtain the necessary force from solenoids, high currents must be passed through the solenoids resulting in significant power dissipation. During certain performances, the pedal solenoids must be activated for long periods of time which will cause the solenoids to overheat and sometimes burn up. Several alternatives have been investigated to eliminate the problem, the first of which was a switch which was activated by the solenoid as it neared the end of its travel. This switch inserted a resistance that reduced the voltage applied to the solenoid and thus reduced the power dissipation while still maintaining the solenoid in the held-in position. The problem with this arrangement is that the adjustments are critical and the switch mechanism is costly to build and install. A second alternative is to simply provide sufficient heat sink material around the solenoid to remove the heat and maintain it at a reasonable working temperature. This approach was found to be unsatisfactory in that it was impractical to provide sufficient heat sink inside a piano to keep the solenoid at a reasonable temperature during extremely long activation periods. Moreover, this heating up effect could be detrimental to the piano itself by drying it out. The solution to this problem according to the present invention maintains full voltage on the solenoid for a short period of time—more than sufficient to allow full travel—and then reduces the applied voltage. This is accomplished by starting a timer when the solenoid is commanded on and then when the timer times out gate the command signal on and off with a waveform which can be set at a duty cycle maintaining the solenoid in the held-in position. The approach is economical in that an existing oscillator in the electronics of the system may be used for gating the waveform and the other components may be mounted on the electronic logic board.

BRIEF DESCRIPTION OF THE DRAWINGS

FIG. 3 is a schematic diagram of the power reduction circuit of the present invention; and FIG. 4A–FIG. 4D inclusive are waveform diagrams which facilitate an understanding of the invention.

FIG. 5 is a bit assignment chart as shown in the aforementioned "Service Manual".

Referring to FIG. 1, the keyboard of a piano is designated by the numeral 10 as a keyboard data source. It could be any musical keyboard instrument such as a harpsichord, carillon, organ, piano, etc. and each output or switch actuation is indicated by lines 11-1 through 11-N, the number of such output lines corresponding to the number of key switch actuations to be sensed or scanned and recorded, for example, 80 keys, and, with respect to the present invention, the "sustain" and "soft" pedals or equivalent thereof of an 88 key piano may be sensed. Multiplexer 12, timed by timing signals from timing source TS, scans or looks at each individual line 11-1 . . . 11-N in a time sequence which constitutes the data frames and also contains the data which indicates whether or not the soft or sustain pedals are to be actuated. The details of such a word format, shown in FIG. 5, is not relevant to the present invention and will not be described in detail herein. They are found in the above-identified Service Manual, which is a publication in the prior art and hence is incorporated herein by reference. Thus, the key switches, expression information (bit positions 105–115), and sustain and soft pedal (bit positions 117 and 118) actuations are sensed by the digital multiplexer 12 one at a time and in a general sequential fashion. However, if no transpositions are contemplated, it is not necessary that they be sequentially examined: They may be looked at or scanned in groups in any fashion or order, the only criteria being that the position of the particular switch and its scan time be maintained in the entire system. Multiplexer 12 thereby translates the parallel data of the key switch actuations to serial data stream along its output line 13 and this serial data stream is in frames of data of 128 bits in length containing the data above-identified along with synchronizing data as produced by synchronizer 10-S and supplied by lines 11-S. This data is then encoded in a phase encoder 14 which receives timing signals from timing source TS, and recorded on magnetic tape in a tape recorder-playback unit 15. Since the present invention is only concerned with the soft and sustain pedal solenoids, only these will be described later herein in detail. However, the solenoids for operating each of the individual keys have the energy supplied thereto controlled so as to control the intensity or expression effects in the playback of the piano. Moreover, the tape may be re-recordings of punched paper rolls, etc. which have expression signal and soft and sustain pedal information recorded therein.

On playback, the output of a read head (not shown) is fed through correcting networks and amplifiers to recover the digital data and this data has included therein the clock data which is recovered by the "time recovery bit drop out sync counter bit and frame counter" units TR and used in the demultiplexing operation. Decoder circuit 17, decodes the incoming bi-phase mark or space data on line 16 and applies same to a demlutiplexer 18 which distributes the data to the appropriate latch control channels in the storage latch circuits 18L and then to solenoid actuator circuits 19. This includes the soft and sustain pedal data to control pedal circuits 19P. The time recovery circuits, etc. TR operate as disclosed in the above-identified applications, and for purposes of the present invention disclosure are incorporated herein by reference.

Figure 1:
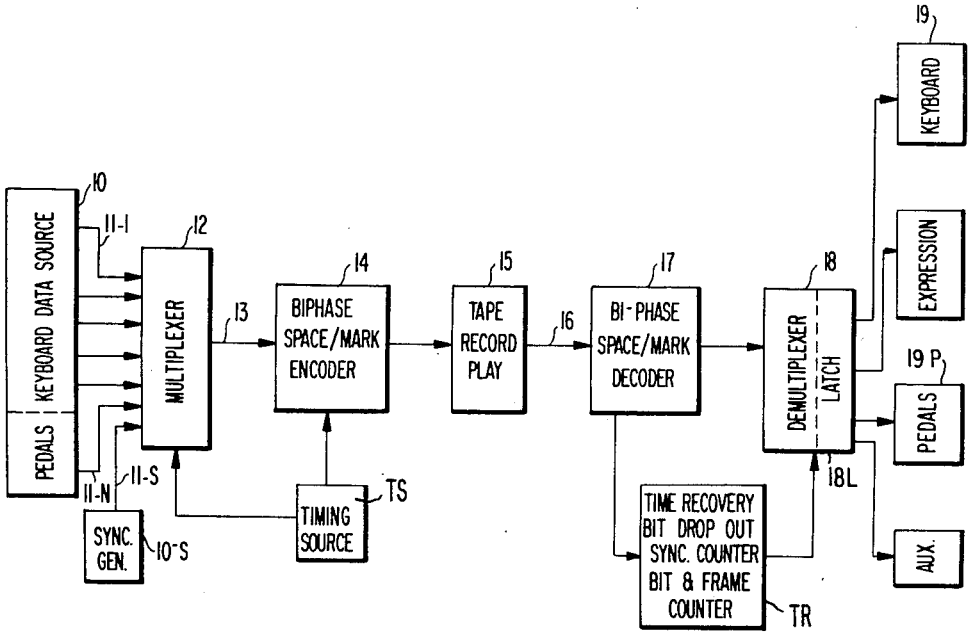
FIG 1 (PRIOR ART)
FIG. 1 is a block diagram of an electronic recorder and player system for musical instruments.
Figure 2:
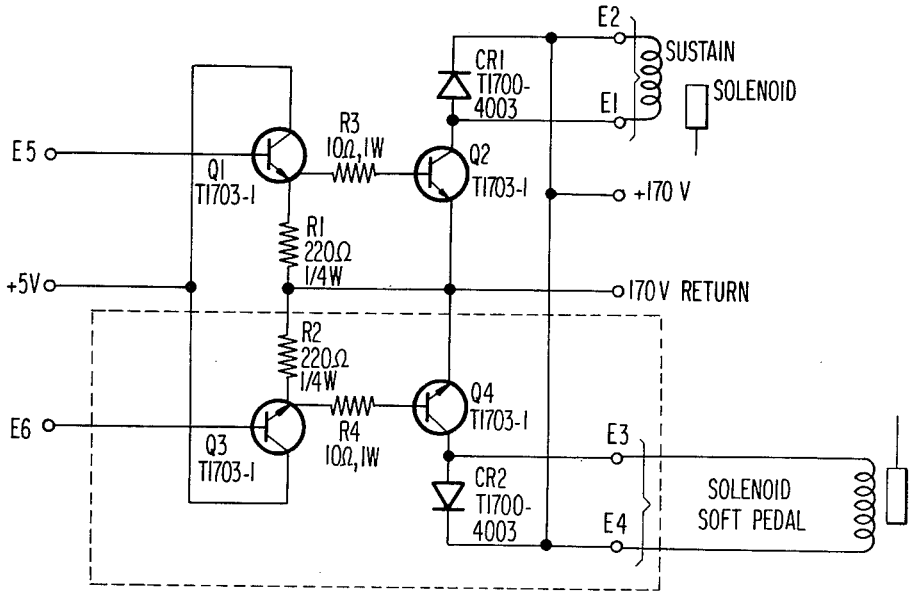
FIG 2 (PRIOR ART)
FIG. 2 is a schematic diagram of the pedal driver circuits for an electronic player piano as manufactured and sold by the assignee hereof and there is fully described in the "Service Manual" for Teledyne Piano Recorder/Player Model PP-1, Assembly No. 3288, ATL 3263 published in October, 1975.

As shown in FIG. 2, the pedal driver schematic includes inputs E5 and E6 from the latch circuits 18L and these are the sustain on inputs on terminal E5 and the soft pedal on input on terminal E6. These are applied to their respective isolating transistors Q1 and Q3, respectively, and the outputs thereof are coupled through resistors R3 and R4 to transistor switches Q2 and Q4, respectively. The solenoid coil for the sustain solenoid is supplied with operating current by transistor Q2 whereas the soft pedal solenoid is supplied by transistor Q4. Diodes CR1 and CR2 are anti-inductive spiking diodes and are conventional.

THE PRESENT INVENTION

Referring to FIG. 3, oscillator 25 may be a separate oscillator or, preferably, is an oscillator contained within the electronics of the player piano itself. However, the source of the oscillatory energy provided by oscillator 25 is supplied via an isolating amplifier inverter 26 to the circuit for use in a manner to be described more fully hereinafter.

The waveform diagrams are shown in FIG. 4A–FIG. 4D, inclusive, and illustrate broadly the basic aspects of the invention. Waveform diagram 4A is the gating waveform from the oscillator. A fifty percent duty cycle is shown in this waveform diagram which, in the present invention, means that it is on for fifty percent of the time. Waveform diagram 4B is the solenoid command signal from the pedal latch circuits in 18L and is the "soft" or "sustain" solenoid command or solenoid on/off command signal. Waveform diagram 4C is the output of the timer and waveform diagram 4D is the solenoid drive signal which illustrates that the initial portion of the drive signal to the solenoid provides for full power to the solenoid, whereas the latter part of the signal shows that the power to the solenoid is reduced fifty percent because of the fifty percent duty cycle of the gating waveform in FIG. 4A.

Referring now to FIG. 3, the circuits for the soft pedal on/off command channel and the sustain pedal on/off command channels are identical, each having its own independent timing circuit. However, the oscillator 25 is common to both circuits but, obviously, separate oscillators or periodic pulse sources may be utilized if desired. The output of oscillator 25 has the waveform shown at 4A which is marked on the output line, and this is applied through an isolating amplifier inverter 26 to the NAND gates 41 and 42 via NAND gates 27 and 28, respectively, of the soft and sustain channels with the second input to the NAND gates 41 and 42 being the soft pedal on/off command signals on line 4B and the sustain pedal on/off command on line 4B' (these designations corresponding to the figures of the waveforms related thereto).

The command signals on lines 4B and 4B' are also applied as trigger inputs to timers constituted by one shot multivibrator circuits 43 and 44, respectively, which have timing circuits R1, C1, which sets the time. The capacitor C2 along with the diode D1 and resistor R2, provides a spike voltage from the leading edge of the soft pedal on/off command signal on line 4B. This starts the soft timer 43 operating with the output (FIG. 4C) thereof set to a low which is thereby a low on one of the inputs to NAND gate 27. The other input of NAND gate 27 is the timer input but this is inhibited by the presence of the low from passing through the gates by the low on the output of timer 43. As soon as the time period set by R1, C1 has passed, which in the present case is about 140 milliseconds, the output of soft timer 43 goes to a high thereby gating the gating waveform of 4A to the NAND gate 41. Thus, the waveform at 4D is produced at the output of NAND gate 41. Sustain timer 44 and its corresponding NAND gates 28 and 42 perform in an identical fashion to soft timer 43 and its related gate circuits. The outputs of NAND gates 41 and 42 are supplied through isolating amplifier inverters 76 and 77, respectively, to the sustain pedal driver transistors (FIG. 2).

By varying the time period of the timer 43–44, the full power time period can be easily adjusted. The gating waveform frequency from oscillator 25 is high enough to prevent pulsing of the solenoid, i.e., greater than 30–40 cycles, and in the present case 200 pulses per second is used. The duty cycle of the gating waveform can be adjusted by adjusting resistor 75 to apply zero to one hundred percent power to the solenoid with the full power time being determined by the on state timing resistor and capacitor R1, C1 with the relationship $T=0.28\times R1\times C1$. The full power time is set to be long enough for the solenoid to be fully pulled in and, as indicated above, for sustain and soft pedal type solenoids as used in conventional player pianos, this is about 140 milliseconds.

While the invention has been described and illustrated herein by reference to a preferred embodiment, it is to be understood that various changes and modifications may be made in the invention by those skilled in the art without departing from the inventive concept, the scope of which is to be determined by the claims appended hereto.

What is claimed is:

1. In an electronic keyboard player musical instrument having solenoid-operated soft and sustain pedals, a plurality of transistor switch means, one transistor switch means being connected to each of said solenoids, respectively, for controlling the voltage supplied to said solenoids and a source of "on" and "off" signals for each of said transistor switch means, the improvement comprising:

means for reducing the hold-in power supplied to said solenoids after the occurrence of said "on" signal, including, for each solenoid of said solenoid-operated pedals:

(1) logic circuit means for applying said "on" signal from said source of "on" and "off" signals to said transistor switch means to turn same "on" for a predetermined time interval sufficient to fully actuate said solenoid, (2) a timing circuit, connected to receive said "on" signal from said source of "on" and "off" signals and initiate said predetermined time interval following the onset of said "on" signal, (3) a source of periodic pulses having a predetermined rate and a predetermined pulse width, and (4) means controlled by said logic circuit for supplying said periodic pulses to said transistor switch means after said predetermined time interval as determined by said timing circuit to thereby reduce the average energy supplied to said solenoid after it has been fully activated to an energy level sufficient to maintain said solenoid actuated for as long as said "on" signal is present.

2. The invention defined in claim 1 including means to adjust the duty cycle of said periodic pulses and thereby vary the average power supplied to said solenoid after said predetermined time interval.

3. The invention defined in claim 1 including means to adjust said timing circuit to thereby adjust said predetermined time interval.

* * * * *